US005639223A

United States Patent [19]

Murakami et al.

[11] Patent Number: 5,639,223

[45] Date of Patent: Jun. 17, 1997

[54] COMPRESSOR WITH CYLINDRICAL CAM SURFACE

[75] Inventors: Kazuo Murakami; Kunifumi Goto; Masahiro Kawaguchi, all of Kariya, Japan

[73] Assignee: Kabushiki Kaisha Toyoda Jidoshokki Seisakusho, Kariya, Japan

[21] Appl. No.: 645,929

[22] Filed: May 14, 1996

Related U.S. Application Data

[63] Continuation of Ser. No. 254,970, Jun. 7, 1994, abandoned.

[30] Foreign Application Priority Data

Jun. 8, 1993 [JP] Japan ..... 5-137836

[51] Int. Cl.[6] ..... F04B 1/12

[52] U.S. Cl. ..... 417/269; 74/567; 74/569; 74/55; 74/56

[58] Field of Search ..... 417/269; 92/71; 74/567, 569, 55, 56

[56] References Cited

U.S. PATENT DOCUMENTS

| | | | |
|---|---|---|---|
| 2,312,228 | 2/1943 | Adair | 417/269 |
| 2,839,008 | 6/1958 | Stansfield et al. | 417/269 |
| 4,756,239 | 7/1988 | Hattori et al. | 92/71 |
| 4,781,539 | 11/1988 | Ikeda et al. | 417/269 |

FOREIGN PATENT DOCUMENTS

| | | | |
|---|---|---|---|
| 3022190 | 8/1982 | Germany | 417/269 |
| 3613353 | 12/1986 | Germany . | |
| 62-121874 | 6/1987 | Japan . | |
| 57110783 | 7/1993 | Japan . | |
| 1756605 | 8/1992 | U.S.S.R. | 417/269 |

OTHER PUBLICATIONS

European Search Report for Appln. No. 94 10 8728.

*Primary Examiner*—Charles G. Freay

*Attorney, Agent, or Firm*—Brooks Haidt Haffner & Delahunty

[57] ABSTRACT

A double-headed piston type compressor has a disk plate. The disk plate is rotatably supported on a drive shaft for driving each piston along a reciprocating path. The plate is curved in a single direction to form a solid cam on its surface. The cam transforms a single rotation of the plate into two reciprocating movements of the piston. Cam followers provided between the plate and the piston are formed to be conform with the shape of the cam. The cam followers contact and roll on the piston, and slide on the cam.

15 Claims, 4 Drawing Sheets

COMPRESSOR WITH CYLINDRICAL CAM SURFACE

This application is a continuation of application Ser. No. 08/254,970, filed Jun. 7, 1994, abandoned.

BACKGROUND OF THE INVENTION

1. Field of the Invention

The present invention relates to a compressor and more particularly to a compressor in which oscillating pistons reciprocate due to the rotation of a cam surfaced plate secured around a drive shaft.

2. Description of the Related Art

In compressors having double-headed pistons that reciprocate in associated cylinder bores by the rotating action of a swash plate, each piston reciprocates only once for each complete revolution the swash plate makes. One way to increase the compressor's compression displacement per rotation of the swash plate, is to design larger sized compressors. Since compressors are often mounted in vehicles, however, their large design is distinctly undesirable.

One proposed solution to the above shortcoming is the recently developed wave plate type compressor disclosed in Japanese Unexamined Patent Publication No. 57-110783. In this compressor, the swash plate is replaced with a plate having the shape of a solid cam. This cam is a disk-shaped plate having circumferentally extending undulating surfaces formed on the plate. If the wave plate has two undulations i.e., two crests and two troughs, each double-headed piston performs two compressing actions for each turn the wave plate makes. It is therefore possible to increase the compression displacement without enlarging the compressor.

To manufacture the wave shaped dish of this type of compressor, the dish must be formed with undulations in the circumferential direction, and its wavy cam surfaces should be polished. It is very difficult, however, to form and polish the undulated surfaces with any high degree of precision. Consequently, the manufacture of such a compressor containing these types of plates has proven quite difficult.

Since the crest and trough of the undulated cam surface have inverse curvatures, it is as yet not possible to form cam followers having shapes that accurately correspond to the crests and troughs of the undulated cam surface. The type of surface contact shared between the cam surface and the cam follower is a point or line contact, rather than a plane contact. This construction precludes there being any large or significant amount of contact area shared between the cam surface and the cam follower. Consequently, both cam surface and follower are subject to a large contact pressure per unit area. Such pressure tends to cause the premature wearing of the cam surface and cam follower, and thus decreases the longevity and effective service life of the compressor. This premature wearing also tends to facilitate the generation of vibration and noise in the compressor during its operation, degrading the overall smooth operation and operating environment of the compressor.

SUMMARY OF THE INVENTION

Accordingly, it is a primary objective of the present invention to provide a compressor which can be manufactured easily.

It is another objective of the present invention to provide a compressor which has a prolonged service life.

It is a further objective of the present invention to provide a compressor which can suppress noise and vibration and can be used comfortably.

To achieve those objectives, according to the present invention, a compressor has a disk plate rotatably supported on a drive shaft for driving a double-headed piston along a reciprocating path defined by a top dead center and a bottom center of a stroke of the piston. A single rotation of said plate causes two reciprocating movements of the piston. A cam member is provided on the plate, the cam member being curved in a single direction. Cam followers are interposed between the cam member and the piston for transmitting the rotation of the plate to the piston.

DETAILED DESCRIPTION OF THE PREFERRED EMBODIMENT

One embodiment of the present invention will now be described referring to the accompanying drawings.

Figure 1:
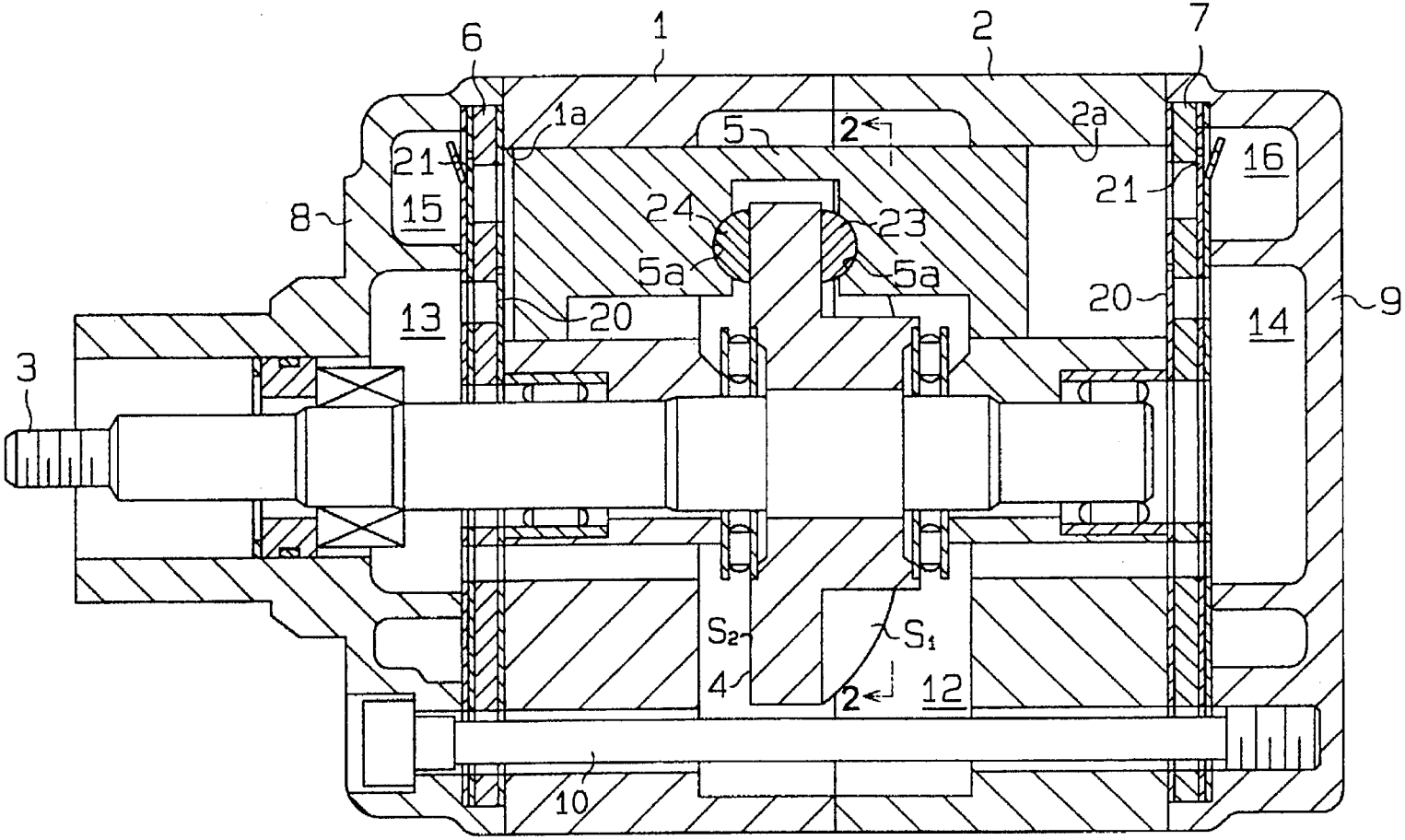
FIG. 1 is a side cross-sectional view showing an overall compressor according to one embodiment of the present invention.
Figure 2:
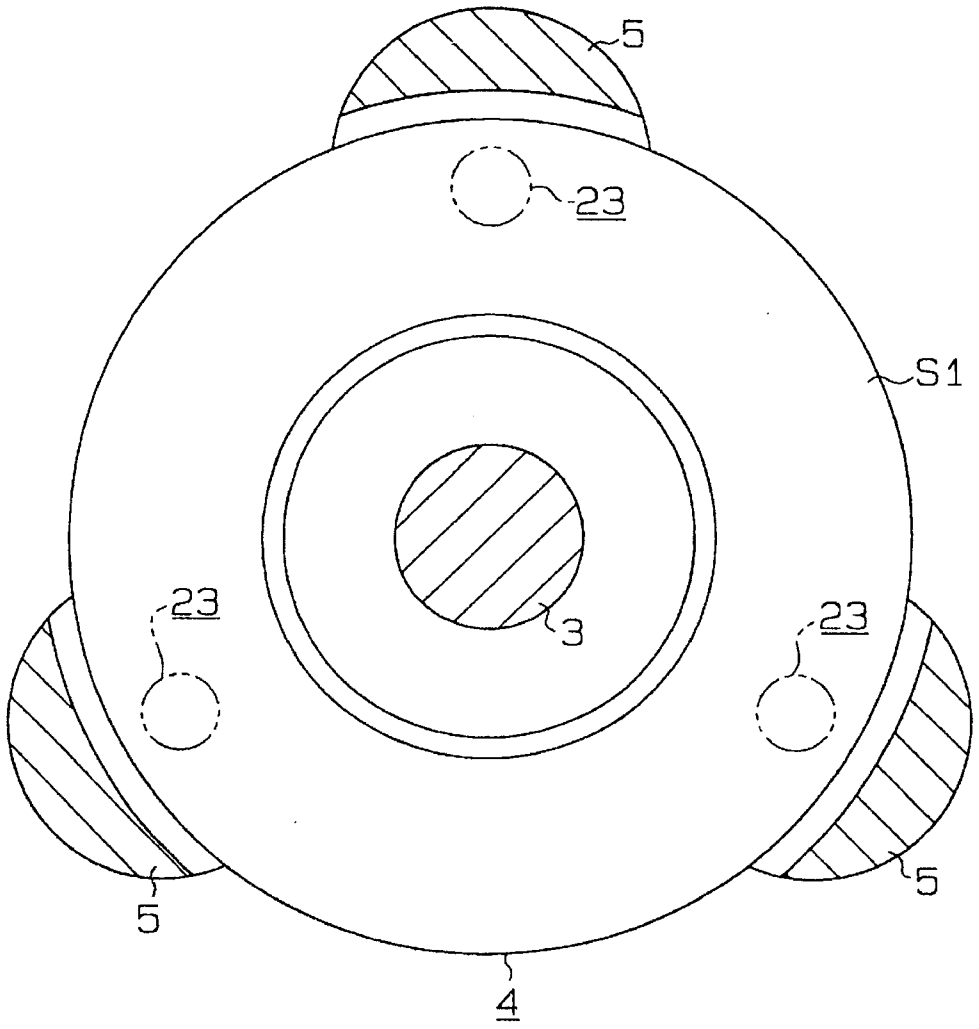
FIG. 2 is a cross sectional view of the compressor taken along the line 2—2 in FIG. 1.

As shown in FIG. 1, a shaft 3 is rotatable supported in a pair of cylinder blocks 1 and 2 which are secured to each other. A disk plate 4 having the shape of a solid cam is secured on the shaft 3. Plural pairs of front cylinder bores 1*a* and rear cylinder bores 2*a* are respectively formed and arranged in the cylinder blocks 1 and 2 at equiangular distances. Double-headed pistons 5 are slidably inserted in the associated cylinder bores 1*a* and 2*a*.

A front housing 8 and a rear housing 9 are arranged at the outer end surfaces of the cylinder blocks 1 and 2 via valve plates 6 and 7. The housings 8 and 9 and the cylinder blocks 1 and 2 are securely fastened together by bolts 10. Suction chambers 13 and 14 and discharge chambers 15 and 16 are respectively defined in the housings 8 and 9. The suction chambers 13 and 14 communicate with a plate chamber 12 and communicate via inlet valves 20 with the cylinder bores 1*a* and 2*a*. The discharge chambers 15 and 16 communicate via discharge valves 21 with the cylinder bores 1*a* and 2*a*. The plate chamber 12 is coupled to the outlet port of the evaporator (not shown) of a refrigerating circuit.

Figure 4:
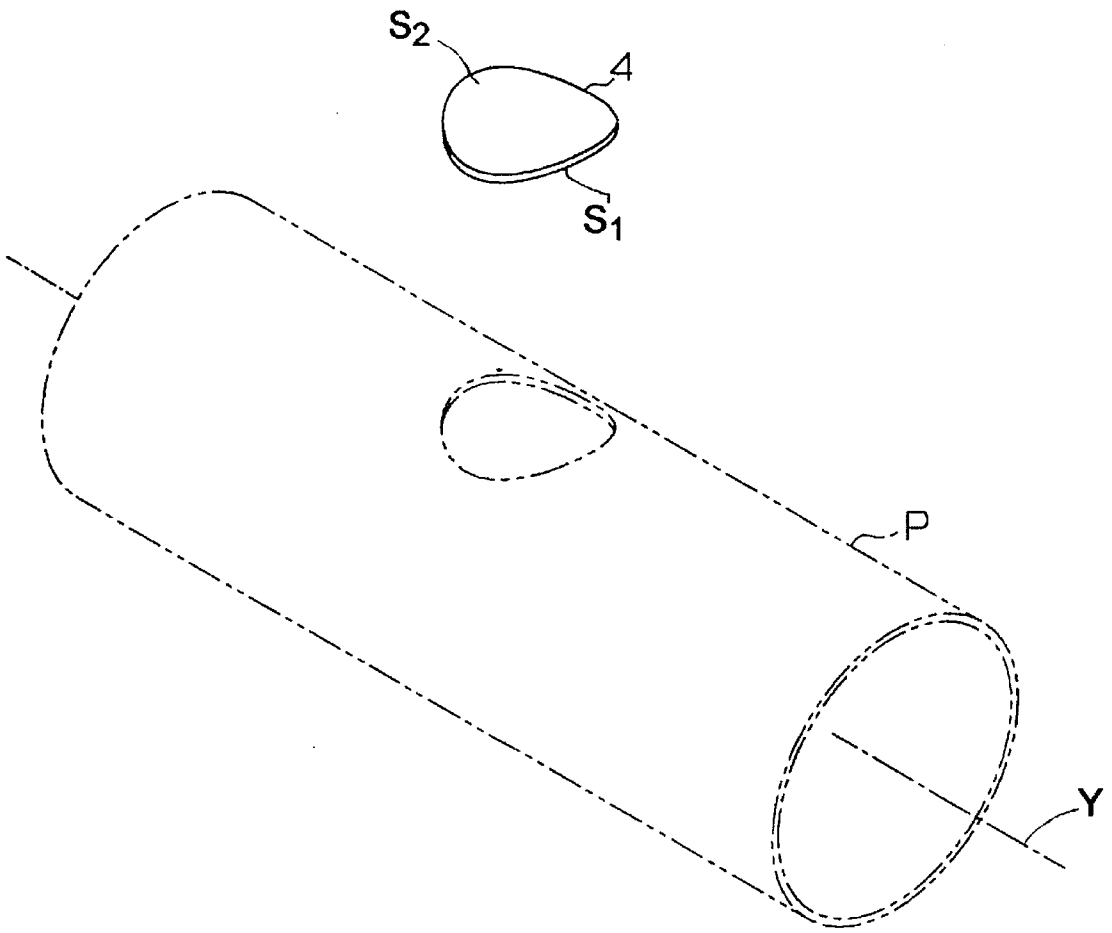
FIG. 4 is a perspective view schematically showing the development of the shape of a wave plate.

As shown in FIG. 4, the plate 4 has the shape of a circular part cut out of an imaginary cylinder P with an axis Y as the center. The plate 4 has cam surfaces S1 and S2 at the top and bottom. More specifically, the cam surface S1 has a concave surface with a uniform curvature, and the other cam surface S2 has a convex surface with a uniform curvature. Accordingly, the cam surfaces S1 and S2 of the plate 4 are curved in one direction and are located on the concentric cylindrical surfaces about the axis Y.

Figure 3:
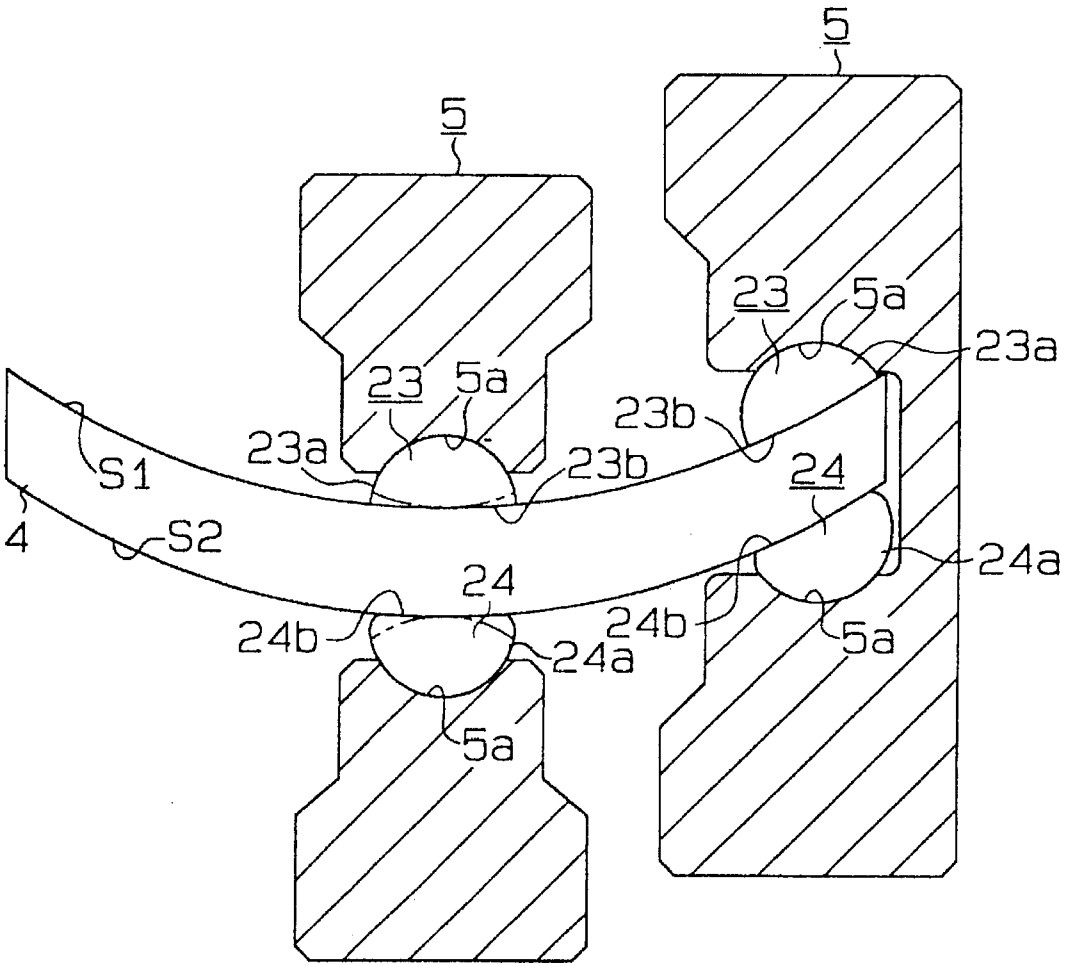
FIG. 3 is a fragmentary partially cross-sectional view of the compressor.

Each piston 5 has a pair of concave spherical recesses 5*a* formed facing the respective cam surfaces S1 and S2 of the plate 4, as shown in FIGS. 1 and 3. Shoes 23 and 24 as cam followers are supported in the recesses 5*a* in order to allow their spherical surfaces 23*a* and 24*a* to rotate. The shoes 23 and 24 are formed with sliding surfaces 23*b* and 24*b* which engage the cam surfaces S1 and S2 of the plate 4. More specifically, the shoe 23, with its convex sliding surface 23*b*, is engaged with the concave cam surface S1. Similarly the shoe 24, with its concave sliding surface 24*b*, is engaged with the convex cam surface S2. The sliding surfaces 23*b* and 24*b* have the same curvatures as the cam surfaces S1 and S2 that contact the former surfaces 23*b* and 24*b*.

The function of the thus constituted compressor will now be described.

As the shaft 3 rotates, the plate 4 turns. Due to the cam function of the plate 4, which has a pair of diametrically opposed axially projecting portions and a pair of diametrically opposed axially retracted portions in quadrature relation to the first pair of portions, each double-headed piston 5 reciprocates in the associated cylinder bores 1*a* and 2*a* via the shoes 23 and 24 to effect the suction, compression and discharge of a fluid. Each piston 5 reaches the top dead center in the cylinder bores 1*a* and 2*a* at the respective end portions in the diametric direction and reaches the bottom dead center at the center portion. The piston 5 therefore has a two-cycle movement, which provides the same advantages as the conventional wave plate type compressor. At this time, as the plate 4 turns, the shoes 23 and 24 change their directions to always face the associated cam surfaces S1 and S2 in the axial direction of the imaginary cylinder P. Both the shoes 23 and 24 slide with respect to the cam surface S1 and S2 without changing their direction.

In this case, the sliding surfaces 23*b* and 24*b* of the shoes 23 and 24 have the same curvatures as the associated cam surfaces S1 and S2. The shoes 23 and 24 therefore are in plane contact with the associated planar surfaces of cam S1 and S2. More specifically, the cam surfaces S1 and S2 are the surfaces of an imaginary cylinder about an axis, so that the curvatures are uniform over the entire surfaces. If the curvatures of the sliding surfaces 23*b* and 24*b* of the shoes 23 and 24 are set equal to those of the cam surfaces S1 and S2, the aforementioned planar contact can be established. It is thus possible to reduce the contact pressure per unit area and prevent early wearing of the cam surfaces S1 and S2 and the shoes 23 and 24. This prolongs the longevity and service life of the compressor. It is also possible to prevent or greatly reduce the occurrence of vibrations and generation of noise during the compressor's operation. This enhances the compressor's smooth operation and overall operating environment.

As mentioned earlier, the disk should be curved in one direction so that the plate 4 forms a part of an imaginary cylinder. It is thus easier to form the plate 4 than the conventional type which contains a plurality of circumferentially extending undulations. In addition, since the cam surfaces S1 and S2 have a uniform curvature over their entire surfaces, they can easily be polished unlike in the case with the undulated plate. The ease of forming and accurately polishing the plate 4 of this embodiment, makes its production and manufacture much simpler than with plates having a conventional design.

What is claimed is:

1. A compressor comprising a cam member rotatably supported on a drive shaft for driving a piston along a reciprocating path defined by a top dead center and a bottom dead center of the piston stroke, wherein a single rotation of said cam member causes two reciprocating movements of the piston, said cam member being cylindrically shaped and having a pair of oppositely facing cam surfaces; said piston including a pair of recesses opposed to each other, each recess having a concave bottom surface; and a first cam follower and a second cam follower respectively interposed between the cam surfaces and the piston to transmit the rotation of the cam member to the piston, each cam follower having a sliding contact surface conforming in shape to its said respective cam surface for sliding on said respective cam surface and having a convex rolling surface for rolling on the concave bottom surface of one of said recesses.

2. A compressor as set forth in claim 1, wherein one of said cam surfaces is convex and the other one of said cam surfaces is concave.

3. A compressor as set forth in claim 1, wherein said first cam follower has a concave contact surface in conformity with the convex surface of the cam member, and said second cam follower has a convex contact surface in conformity with the concave surface of the cam member.

4. A compressor as set forth in claim 1, wherein said cam member has a pair of diametrically opposed axially projecting portions and a pair of diametrically opposed axially retracted portions in quadrature relation to said first pair of portions for driving the piston to said upper dead center and to said lower dead center, respectively.

5. A compressor as set forth in claim 1, wherein each contact surface contacts and slides on the associated surface of the cam member over the entire length of the contact surface.

6. A compressor comprising a cam member rotatably supported by a drive shaft for driving a piston along a reciprocating path defined by a top dead center and a bottom dead center of the stroke of the piston, wherein a single rotation of said cam member causes two reciprocating movements of the piston, said cam member being cylindrically shaped and having a pair of oppositely facing cam surfaces, wherein one of said cam surfaces is convex and the other one of said cam surfaces is concave;

said piston having a pair of recesses opposed to each other, wherein each recess has a concave bottom surface; and a first cam follower and a second cam follower respectively interposed between the cam surfaces and the piston, each cam follower having a sliding surface for sliding on said respective cam surface and having a convex rolling surface for rolling on the concave bottom surface of one of said piston recesses;

said first cam follower having a concave contact surface in conformity with the convex cam surface of the cam member, and said second cam follower having a convex contact surface in conformity with the concave cam surface of the cam member, whereby each contact surface contacts and slides on the associated surface of the cam member over the entire length of the contact surface.

7. A compressor as set forth in claim 6, wherein said cam member has a pair of diametrically opposed axially projecting portions and a pair of diametrically opposed axially retracted portions in quadrature relation to said first pair of portions for driving the piston to said upper dead center and to said lower dead center, respectively.

8. A compressor for use in a vehicle, said compressor comprising a solid cam disk operably linked to a plurality of pistons, said cam disk being supported on a rotary drive shaft for integral rotation therewith, wherein a single rotation of the disk causes a plurality of reciprocating movements of each piston, said cam disk being curved in a single direction and having a convex surface and a concave surface, respectively;

each piston having a pair of recesses opposed to each other, wherein each recess has a concave bottom surface;

a first cam follower and a second cam follower, each cam follower having a convex rolling surface for rolling on the concave bottom surface of a respective one of the piston recesses; and said first cam follower having a concave contact surface in conformity with the convex surface of the cam disk, and said second cam follower having a convex contact surface in conformity with the concave surface of the cam disk, whereby each contact surface contacts and slides on the associated surface of the cam disk over the entire length of the contact surface.

9. A compressor as set forth in claim 8, wherein said cam member has a pair of diametrically opposed axially projecting portions and a pair of diametrically opposed axially retracted portions in quadrature relation to said first pair of portions for driving the piston to said upper dead center and to said lower dead center, respectively.

10. A compressor comprising a cam member rotatably supported by a drive shaft for driving a piston along a reciprocating path defined by a top dead center and a bottom dead center of the stroke of the piston, wherein a single rotation of said cam member causes two reciprocating movements of the piston, said cam member having a pair of oppositely facing cam surfaces each defined by a part of a cylindrical surface, wherein one of said cam surfaces is convex and the other one of said cam surfaces is concave;

said piston having a pair of recesses opposed to each other, wherein each recess has a concave bottom surface;

a first cam follower and a second cam follower respectively interposed between the cam surfaces and the piston, each cam follower having a sliding surface for sliding on the associated cam surface and having a convex rolling surface for rolling on the convex bottom surface of one of said piston recesses;

said first cam follower having a concave contact surface in conformity with and in engagement with the convex cam surface of the cam member, said second cam follower having a convex contact surface in conformity with and in engagement with the concave cam surface of the cam member, whereby each contact surface contacts and slides on the associated surface of the cam member over the entire length of the contact surface; and each of said cam surfaces has a pair of diametrically opposed axially projecting portions and a pair of diametrically opposed axially retracted portions in quadrature relation to said first pair of portions to drive the piston to said upper dead center and to said lower dead center, respectively.

11. A compressor for use in a vehicle, comprising a solid cam disk operably linked to a plurality of pistons, said cam disk being supported on a rotary drive shaft for integral rotation therewith, wherein a single rotation of the disk causes a plurality of reciprocating movements of each piston, said cam disk being cylindrically shaped with a convex cam surface on one side and a concave cam surface on the opposite side;

each said piston having a pair of recesses opposed to each other, wherein each recess has a concave bottom surface;

a first cam follower and a second cam follower respectively interposed between the cam surfaces and the piston, each cam follower having a sliding surface for sliding on said respective cam surface and a convex rolling surface for rolling on the concave bottom surface of a respective one of said piston recesses;

said first cam follower having a concave contact surface in conformity with said convex cam surface of the cam disk, and said second cam follower having a convex contact surface in conformity with said concave cam surface of the cam disk, whereby each contact surface contacts and slides on the associated cam surface of the cam disk over the entire length of the contact surface; and each of said cam surfaces has a pair of diametrically opposed axially projecting portions and a pair of diametrically opposed axially retracted portions in quadrature relation to said first pair of portions to drive said piston to said upper dead center and to said lower dead center, respectively.

12. A compressor comprising a cam member rotatably supported on a drive shaft for driving a piston along a reciprocating path defined by a top dead center and a bottom dead center of the piston stroke, wherein a single rotation of said cam member causes two reciprocating movements of the piston, said cam member having a cam surface defined in its entirety by a part of a surface of an imaginary cylinder, said piston including a recess having a concave bottom surface; and a cam follower interposed between the cam surface and the piston to transmit the rotation of the cam member to the piston, said cam follower having a sliding contact surface for sliding on said cam surface and having a convex rolling surface for rolling on the concave bottom surface of said recess.

13. A compressor comprising a cam member rotatably supported on a drive shaft for driving a piston along a reciprocating path defined by a top dead center and a bottom dead center of the piston stroke, wherein a single rotation of said cam member causes two reciprocating movements of the piston, said cam member having a pair of cam surfaces respectively defined in their entirety by parts of a pair of oppositely facing surfaces of an imaginary hollow cylinder, said piston having a pair of recesses opposed to each other, each of said recesses having a concave bottom surface; and a first cam follower and a second cam follower respectively interposed between each of the cam surfaces and the piston to transmit the rotation of the cam member to the piston, each of said cam followers having a sliding contact surface for sliding on its associated cam surface and having a convex rolling surface for rolling on the concave bottom surface of one of said recesses.

14. A compressor comprising:

a drive shaft;

a piston, which is adapted to move in a linear path defined by a top dead center and a bottom dead center, said piston including a recess having a concave surface;

a cam member rotatably supported on the drive shaft for driving the piston along the linear path, wherein a single rotation of said cam member causes two reciprocating movements of the piston, wherein one side of the cam member is a curved cam surface that is defined entirely by a section of a surface of an imaginary cylinder;

a cam follower located between said cam surface and the piston to transmit the rotation of the cam member to the piston, said cam follower having a sliding contact surface for sliding on said cam surface and having a convex rolling surface for rolling on the concave surface of the recess.

15. A compressor comprising:

a drive shaft;

a piston which is adapted to move in a linear path defined by a top dead center and a bottom dead center, said piston including a pair of recesses, each having a concave surface;

a cam member rotatably supported on the drive shaft for driving the piston along the linear path, wherein a single rotation of said cam member causes two reciprocating movements of the piston, and wherein said cam member has oppositely facing sides, and each side of the cam member is a curved cam surface that is defined entirely by a section of the surface of an imaginary cylinder, one side being concave and the opposite side being convex;

a pair of cam followers, one being located between each cam surface and the piston to transmit the rotation of the cam member to the piston, each cam follower having a sliding contact surface for sliding on one of the cam surfaces and having a convex rolling surface for rolling on the concave surface of the recess.

* * * * *